US005987825A

United States Patent [19]

Rosen

[11] Patent Number: 5,987,825

[45] Date of Patent: Nov. 23, 1999

[54] MODULAR MESSAGE CENTER

[75] Inventor: Lawrence I. Rosen, Mendham, N.J.

[73] Assignee: Rose Art Industries, Inc., Livingston, N.J.

[21] Appl. No.: 09/036,318

[22] Filed: Mar. 6, 1998

[51] Int. Cl.[6] ..... G09F 15/00

[52] U.S. Cl. ..... 52/36.1; 52/592.1; 52/592.2; 52/592.3; 40/611

[58] Field of Search ..... 52/36.1, 592.1, 52/592.2, 592.3, 239; 40/611, 618; 428/14

[56] References Cited

U.S. PATENT DOCUMENTS

| | | |
|---|---|---|
| D. 268,118 | 3/1983 | Herr . |
| D. 270,074 | 8/1983 | Read . |
| D. 371,806 | 7/1996 | Boone . |
| D. 377,948 | 2/1997 | Pruhs . |
| D. 388,459 | 12/1997 | Jack . |
| D. 390,263 | 2/1998 | Jack . |
| 4,133,123 | 1/1979 | Anderson . |
| 5,295,342 | 3/1994 | Roche . |
| 5,527,568 | 6/1996 | Boone . |
| 5,658,635 | 8/1997 | Davis . |

*Primary Examiner*—Christopher T. Kent
*Attorney, Agent, or Firm*—Allen N. Friedman; McCarter & English LLP

[57] ABSTRACT

A modular message center consisting of at least two multi-functional modules can be assembled with the modules in at least two different relative positions. The modules incorporate a plurality of messaging and informational functions, such as cork board, dry-erase, adhesive notes, calendar, and magnetic message board. The main module is, preferably, square so that the supplemental modules can be attached to either side, top or bottom, with equal facility. The modules can be arrayed in horizontal, vertical, extended horizontal or extended vertical formats. The message center may be, for example, hung on a wall or magnetically affixed to a metallic surface, such as a refrigerator. The frame around one or more of the modules can be fitted to permit storage of felt tip markers or other writing implements along the length of frame member.

11 Claims, 7 Drawing Sheets

MODULAR MESSAGE CENTER

BACKGROUND OF THE INVENTION

1. Field of the Invention

The invention relates to the modular configuration of a board for the posting of messages in a plurality of formats.

2. Brief Description of the Background Art

There is a broad patent literature concerning bulletin boards of various types. Some patents disclose single function board surfaces, such as dry-erase (U.S. Pat. No. D.377,948, issued Feb. 11, 1997) or tack board (U.S. Pat. No. 4,133,123, issued Jan. 9, 1979), with various appended devices. U.S. Pat. No. 5,295,342, issued Mar. 23, 1994, discloses a composite board material that will accept both tack mounted notes and magnet mounted notes. U.S. Pat. No. D.371,806, issued Jul. 16, 1996, and U.S. Pat. No. 5,527,568, issued Jun. 18, 1996, each show a bulletin board with both a cork-board surface and a dry-erase surface. More complex devices offering various combinations of functionality are disclosed in U.S. Pat. No. D.390,263, issued Feb. 3, 1998, U.S. Pat. No. D.268,118, issued Mar. 1, 1983. All of these devices represent a continuing attempt to meet the needs of various prospective users.

SUMMARY OF THE INVENTION

The invention is a modular multifunctional message center that accommodates to the needs of many users by permitting them to select modules incorporating the messaging functions that best serve them and to organize those functions in a manner best serving their needs by attaching the modules to one another as they wish. For example, placement of a supplemental module to the left of the main module may be more convenient for left-handed users. In accordance with the invention, a modular message center consisting of at least two multifunctional modules can be assembled with the modules in at least two different relative positions. The modules incorporate a plurality of messaging and informational functions, such as cork board, dry-erase, adhesive notes, calendar, and magnetic message board. The main module is, preferably, square so that the supplemental modules can be attached to either side, top or bottom, with equal facility. The modules can be arrayed in horizontal, vertical, extended horizontal or extended vertical formats. The message center may be, for example, hung on a wall or magnetically affixed to a metallic surface, such as a refrigerator. The frame around one or more of the modules can be fitted to permit storage of felt tip markers or other writing implements along the length of frame members.

DETAILED DESCRIPTION OF THE INVENTION

Each modular message center of the invention includes at least two rectangular multifunctional modules, each module embodying messaging functions such as a dry-erase board, an eraser, a calendar (preferably providing space for noting appointments), a cork-board, a holder for a pad of adhesive notes, a magnetic message board, or a pocket for holding miscellaneous objects, such as a supply of cork-board pins or coins. Each such message center has a main module, which is preferably square and one or more supplemental modules preferably, with one dimension approximately equal in length to one side of the main module.

At least two contiguous edges of the main module are provided with means for attaching the main module to the supplemental modules and one edge (preferably the edge that is of the same length as the mating main module edge) is provided with a mating attachment means. The supplemental module can, then, be attached to one or another other edge of the main module to meet the needs of the user or best fit into the available mounting area. For example, for refrigerator mounting a side-by-side attachment would be more appropriate for use with a top-or-bottom-freezer refrigerator, while a side-by-side attachment would be more appropriate for use with a side-by-side refrigerator freezer. If three edges of the main module are provided with attachment means, the supplemental module can be attached on either side of the main module. The user also is able to select the modules that best meet his communication needs. The various possibilities are exemplified in the figures.

Figure 1:
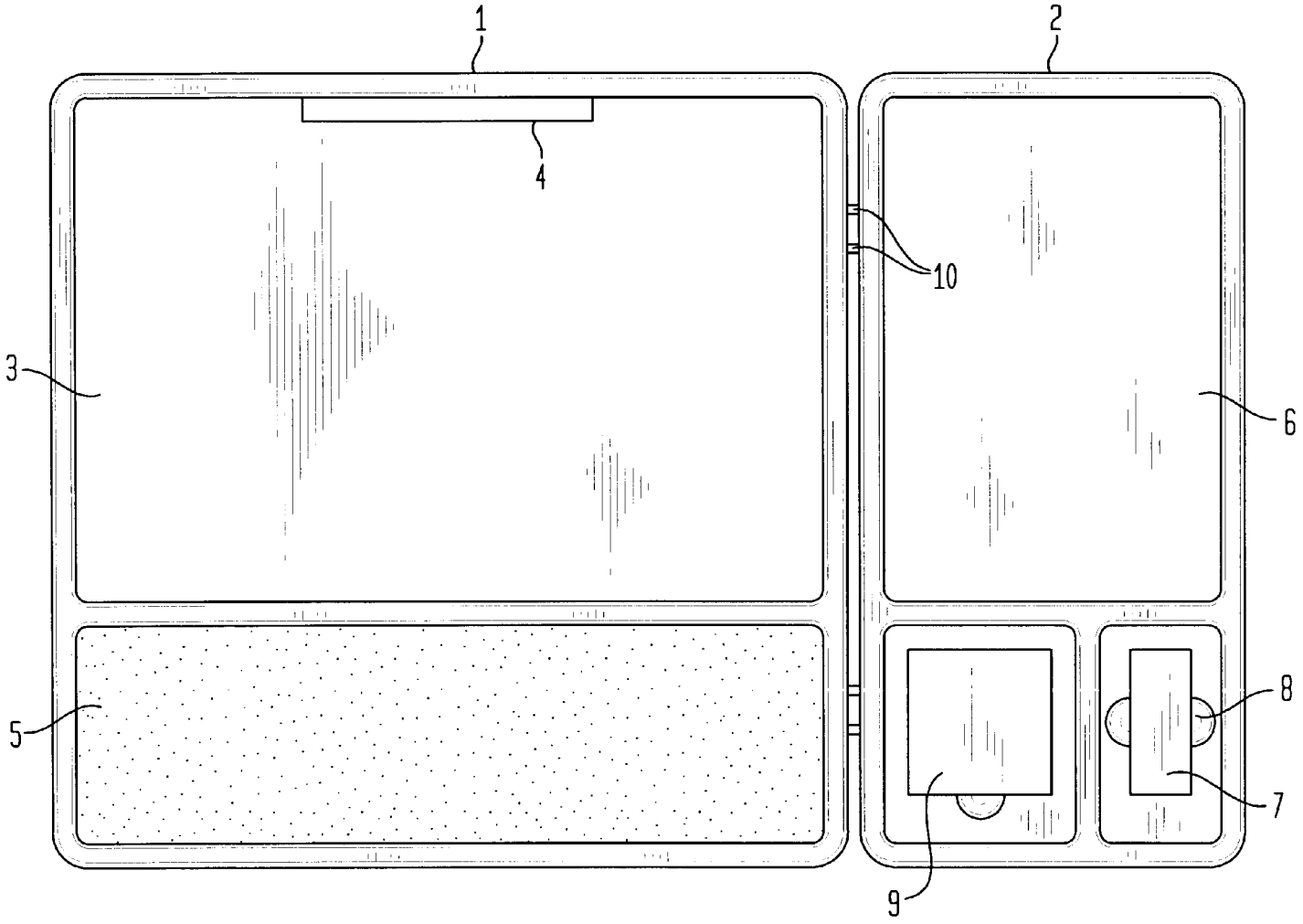
FIG. 1 is a plan view of an exemplary two module message center in a horizontal format with a supplemental module to the right of the main module.

FIG. 1 shows a main module 1 and a supplemental module 2 attached side-by-side in a horizontal format. The upper area 3 of the main module 1 may be sized appropriately to hold a calendar, with, perhaps an attachment device 4, such as a clamp or book. The lower portion 5 is shown as a cork-board or porous, resilient material adapted for being repeatedly pierced by a note mounting pin. The supplemental module 2 is illustrated with a dry-erase surface 6 and an eraser 7 held in a depression in the module's surface. Shallow finger grips 8 are shaped at the edges of the depression to aid in removal of the eraser 7. To the left of the eraser 7 is a pad of adhesive notes 9. For illustrative purposes the modules 1, 2 are slightly separated to show the attachment means 10. In actual use the modules 1, 2 are, preferably, held against one another so that the attachment means will not show.

Figure 2:
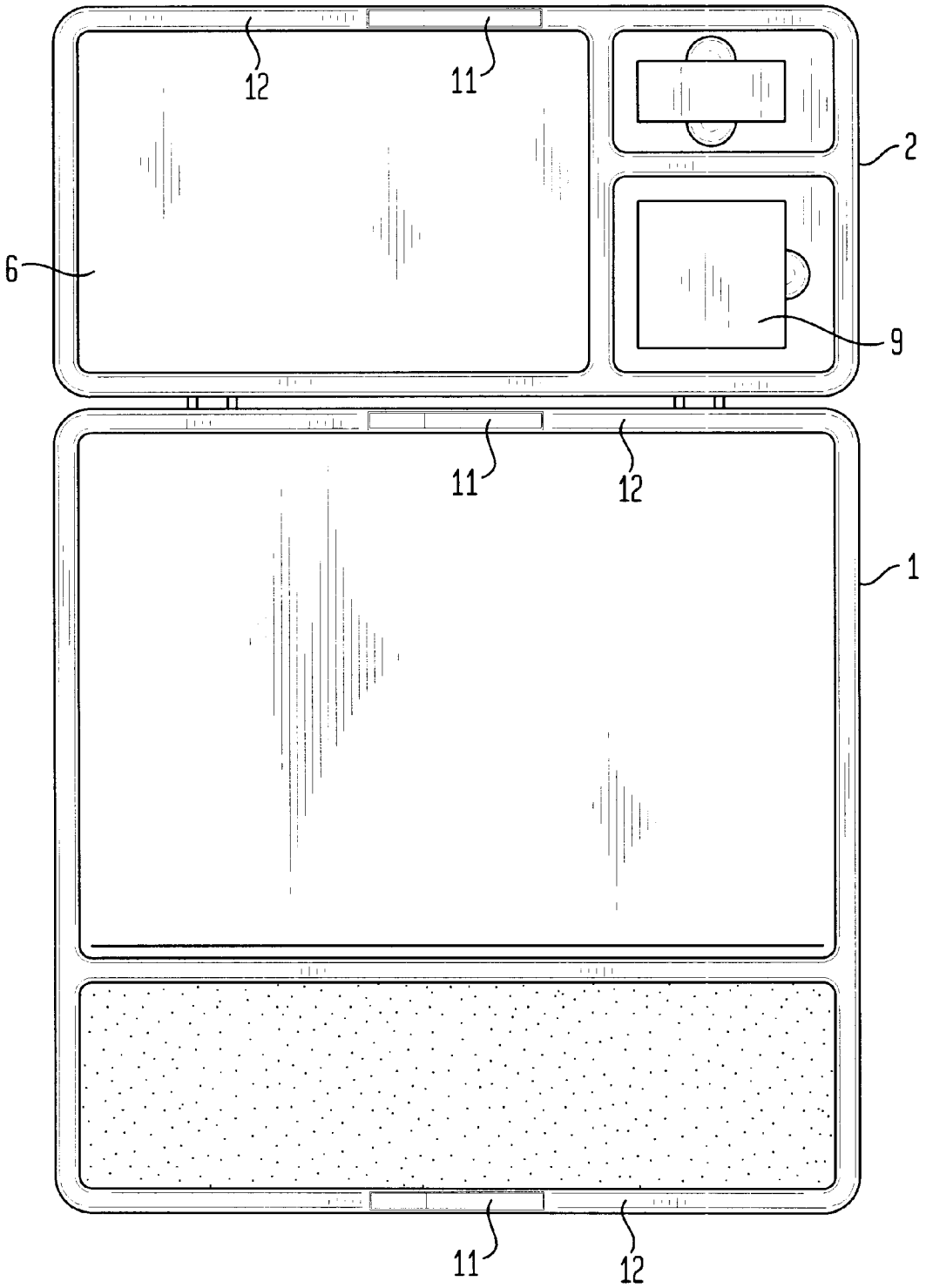
FIG. 2 is a plan view of an exemplary two module message center in a vertical format with a supplemental module above the main module.

FIG. 2 shows the supplemental module 2 attached above the main module 1 in a vertical format. In the figure, markers 11 are stored in the module frame. They may be held by clips, by being pressed into a suitably formed depression, by spring loaded end clamps, or by one of many other holding methods known to the art. They are held in alignment with the frame member 12 to which they are attached. The markers 11 may include broad-line dry-erase markers for writing on the dry-erase surface 6 or a finer line writing implement, such as a pen for writing on the adhesive notes 9 or calendar 3.

Figure 3:
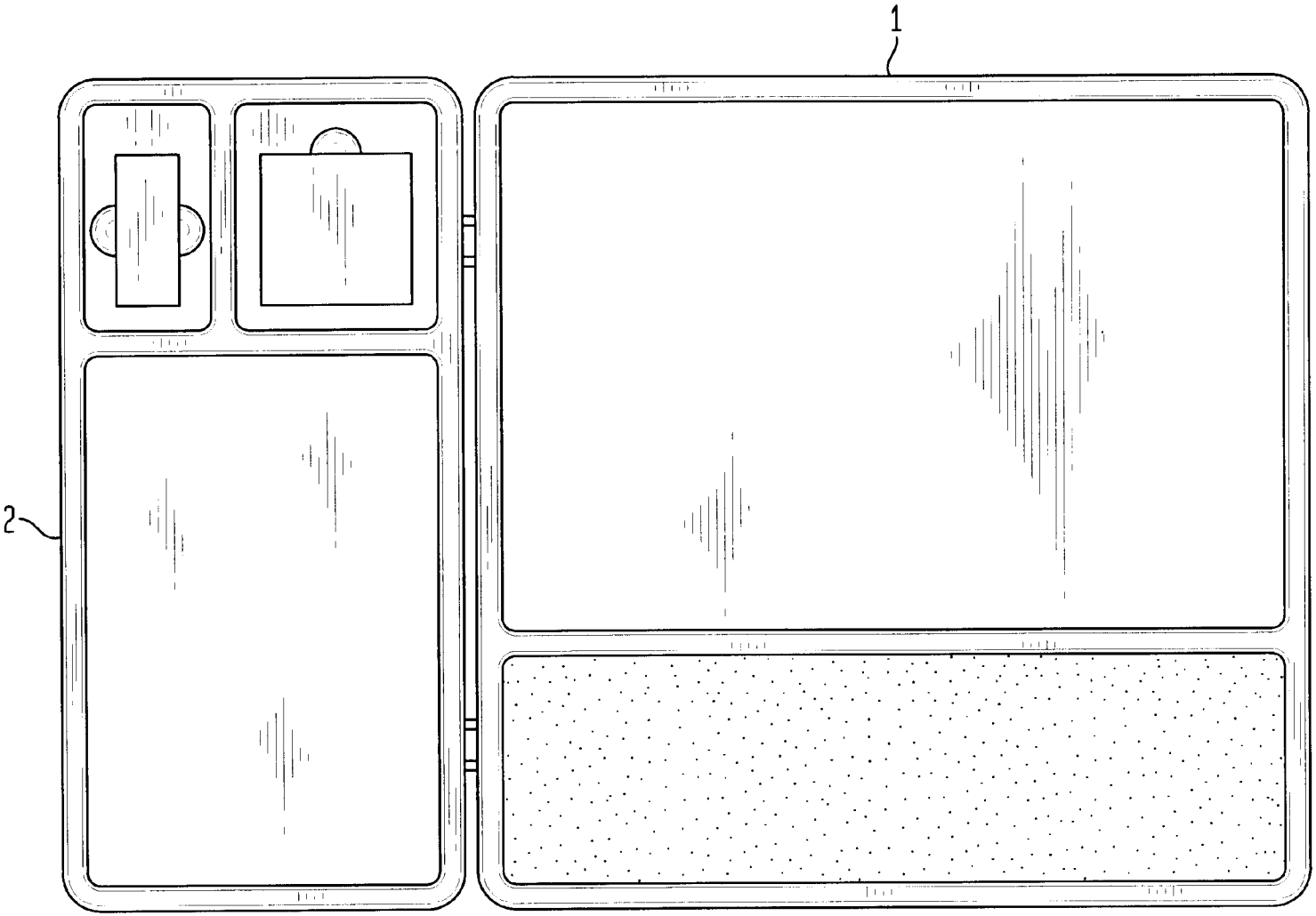
FIG. 3 is a plan view of an exemplary two module message center in a horizontal format with a supplemental module to the left of the main module.

FIG. 3 shows the supplemental module 2 attached to the left of the main module 1, as might be elected by a left-handed person.

Figure 4:
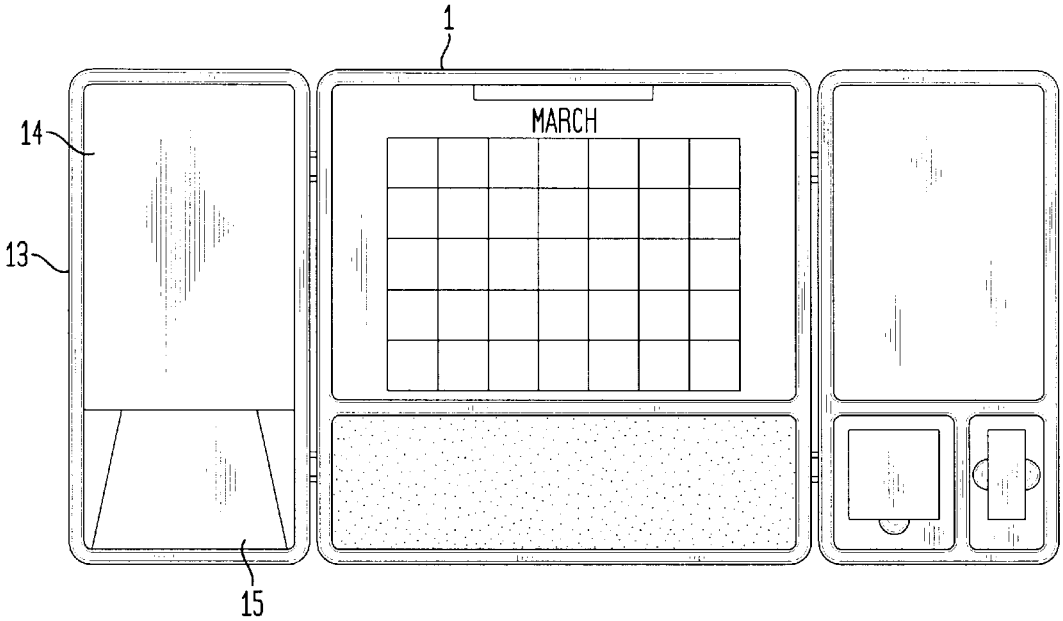
FIG. 4 is a plan view of an exemplary three module message center in a horizontal format with supplemental modules on either side of the main module.
Figure 5:
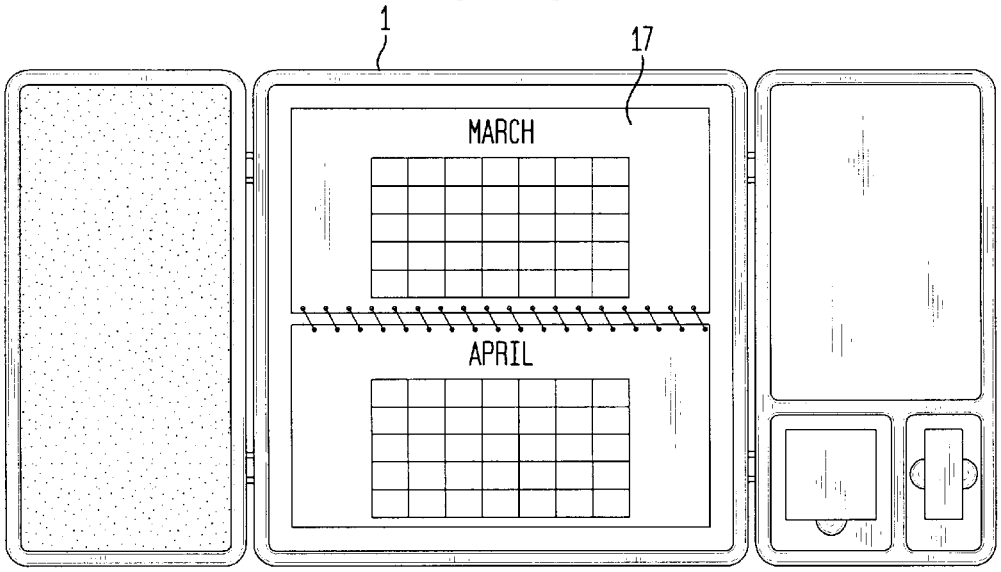
FIG. 5 is a plan view of an exemplary two module message center in a horizontal format with the main module rotated by 90 degrees in order to accommodate a two month calendar display.
Figure 7:
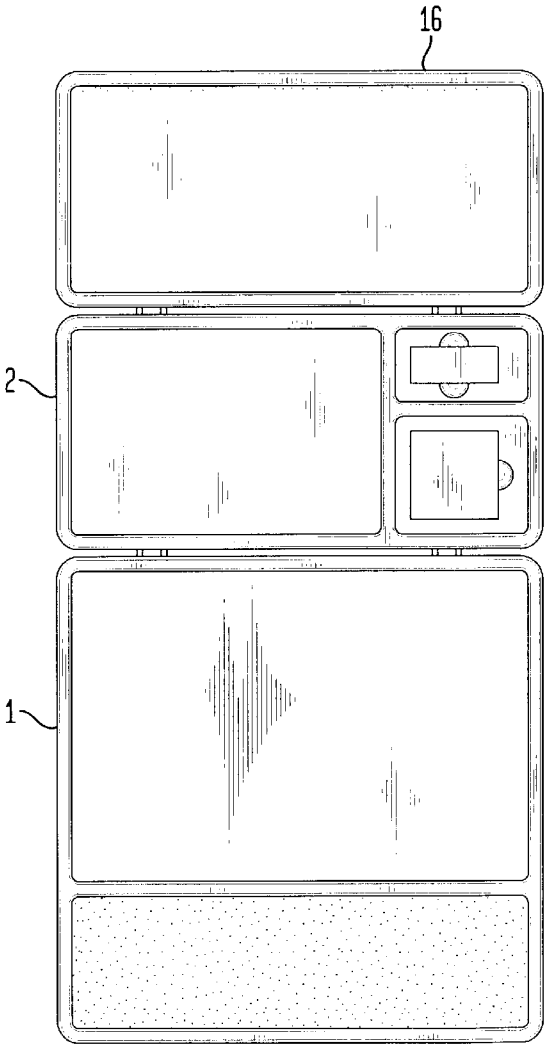
FIG. 7 is a plan view of an exemplary three module message center in an extended vertical format, with two supplemental modules above the main module.
Figure 6:
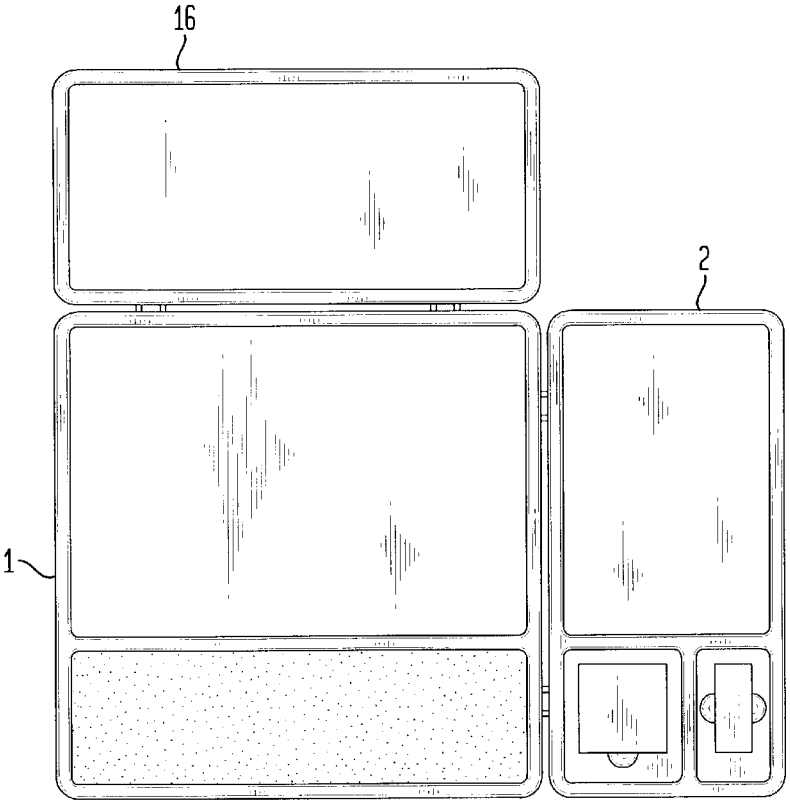
FIG. 6 is a plan view of an exemplary three module message center in a mixed format, with supplemental modules to the right and above the main module.

FIG. 4 shows a three-module message center in an extended horizontal format. The supplemental module 13 to the left of the main module 1 may be provided with a magnetic message surface 14 and a pocket 15 for holding such things as magnets, push-pins, or coins. In FIG. 5 the main module 1 is shown rotated by 90 degrees, as may be useful to accommodate a calendar 17 displaying two successive months. The message center illustrated in FIG. 7 is in an extended vertical format with a third module 16 affixed above the other two modules 1, 2. This module may be a single function magnetic message surface or, for example, a second dry-erase surface, or a magnetic message surface that is coated to accept dry-erase writing. FIG. 6 shows a mixed format arrangement, with one supplemental module 2 to the right of the main module 1 and another 16 above the main module 1. If, for example, additional dry-erase surface is desired, a longer supplemental module 18, such as illustrated in FIG. 12, may be employed.

Figure 8:
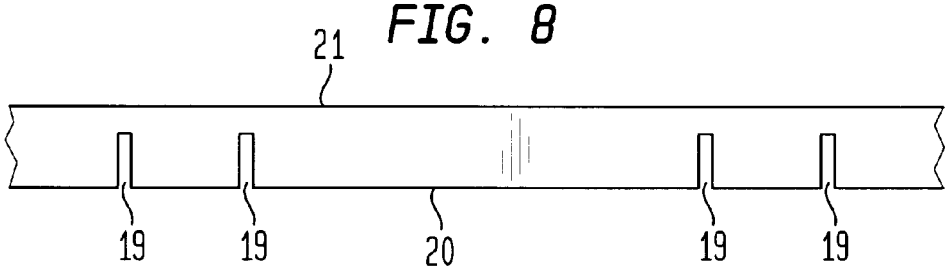
FIG. 8 is an elevational view of a portion of the perimeter of a module frame, showing an exemplary female attachment means.
Figure 9:
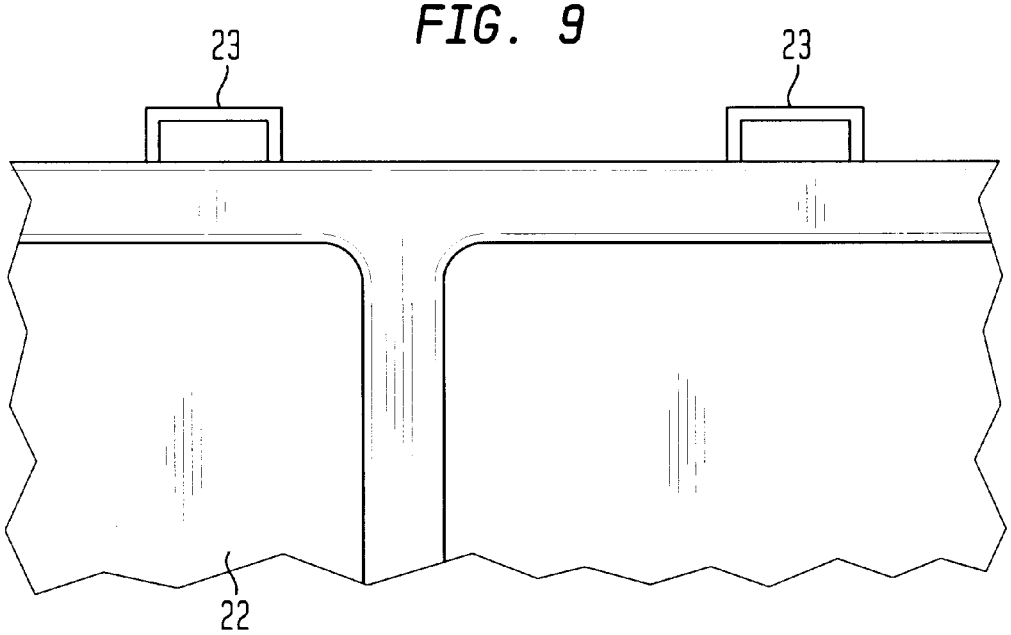
FIG. 9 is a plan view of a portion of module frame, showing an exemplary male attachment means.
Figure 10:
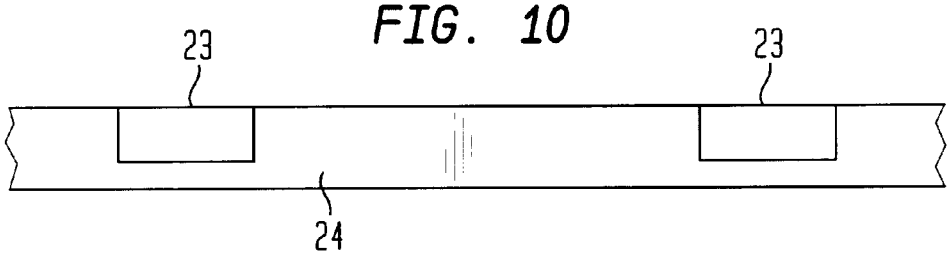
FIG. 10 is an elevational view of a portion of the perimeter of a module frame, showing an exemplary male attachment means.

There are many kinds of devices that are known in the art for use in attaching the modules to one another. Most such attachment devices consist of a male part that protrudes from one element being attached and mates with a female part formed in the other element. FIGS. 8, 9 and 10 illustrate one such attachment system that can be used for modules in which the frame perimeter is formed as a thin shell. FIG. 8, viewing the frame 21 from its side, shows slots 19 extending from the lower edge 20 of the frame member 21, as the female element of the attachment system. FIG. 9, viewing the mating module from the top, shows the male element of the attachment system as a U-shaped stirrup 23. FIG. 10 shows the stirrup 23 as extending only partway up from the bottom edge of the frame member 24, so as to fit properly in the slots 19 and hold the mating modules together in the same place, as a message center.

If a male-female attachment system is used, it is preferable that the main module carry the female elements so that any elements not in use do not protrude visibly from the frame edge. The supplemental modules are, preferably, made with male elements formed in one edge and, if desired, female elements formed in the other edge. In this manner, the protruding male elements will always be hidden and, if unused, the female elements will not be unsightly.

Figure 12:
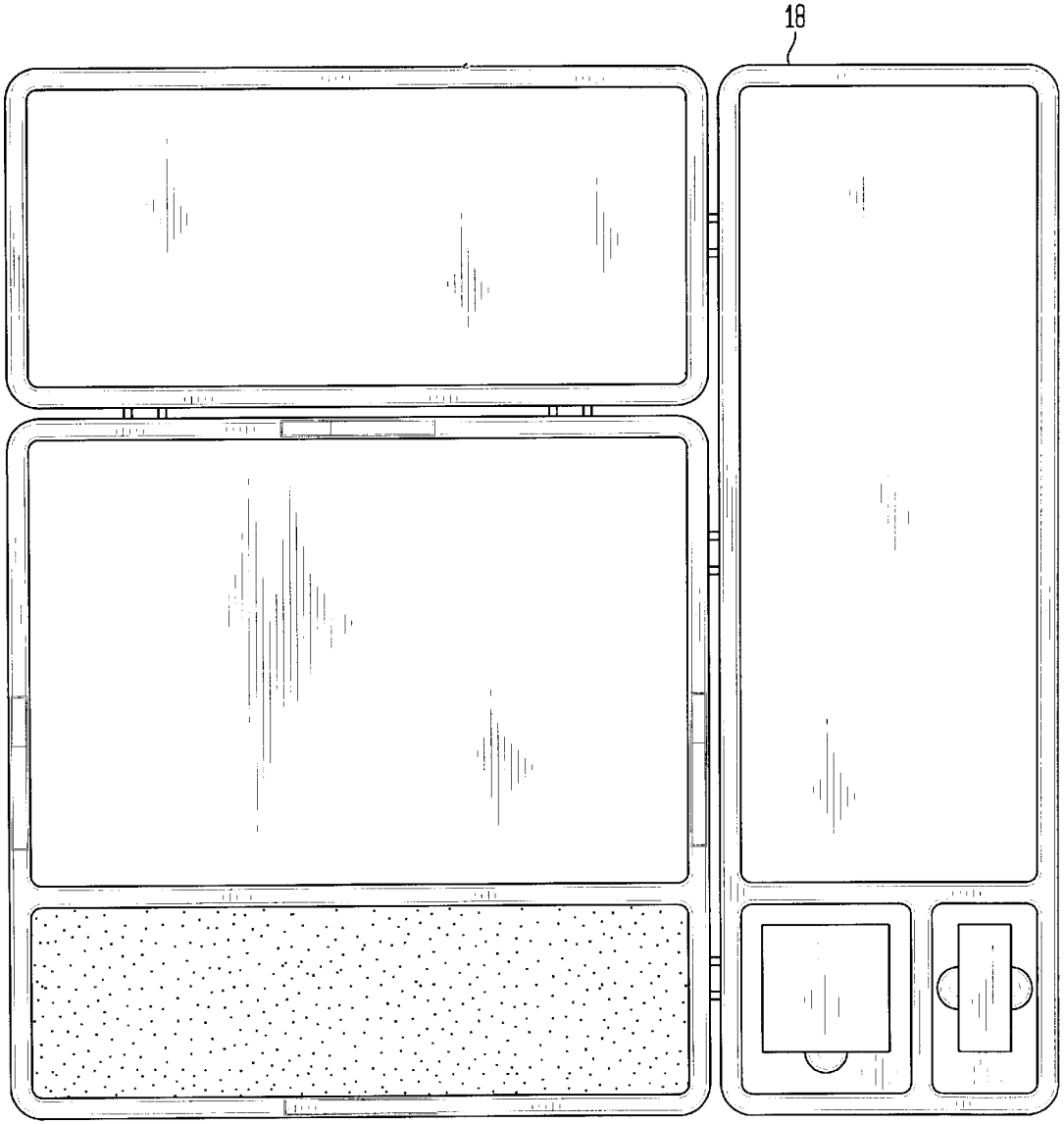
FIG. 12 is a plan view of an exemplary three module message center, with an extended supplemental module.
Figure 11:
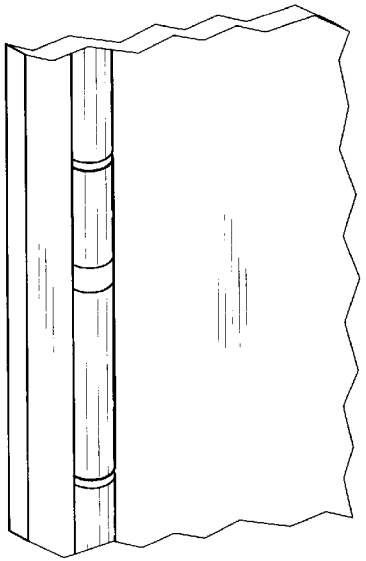
FIG. 11 is a perspective view of a portion of an exemplary module with a marker stored longitudinally in the module frame.

A message board with in-frame marker storage configured for example as the main module in FIGS. 2 or 12 could find independent utility for convenient and attractive marker storage.

What is claimed is:

1. A modular message center with a main module and at least one supplemental module, each module including a frame and at least one functional area, each module being approximately rectangular and, wherein:

a) the main module includes at least two functional areas and the main module frame includes female attachment means arrayed along the outer perimeter of at least two contiguous edges; and b) each supplemental module includes male attachment means arrayed along the outer perimeter of only one frame edge and so situated as to permit engagement with the female attachment means whereby the supplemental module is attachable to the main module at any main module edge provided with female attachment means.

2. A device of claim 1 in which the main module is square and the supplemental module's longer frame edge is approximately equal in length to the main module's frame edge.

3. A device of claim 1 in which the main module frame includes female attachment means arrayed along the outer perimeter of at least three edges.

4. A device of claim 1 in which at least one supplemental module frame includes female attachment means arrayed along the outer perimeter of an edge that is opposite the edge possessing male attachment means.

5. A device of claim 1 in which the at least one functional area included in each module is a calendar, or a cork board, or a dry-erase message surface, or a holder for an eraser or a holder for a pad of adhesive notes, or a magnetic message board.

6. A device of claim 4 in which each module includes at least two functional areas.

7. A device of claim 1 in which the frame of at least one module includes a frame member comprising means for storing at least one writing means in an orientation colinear with the frame member.

8. A device of claim 1 in which the male attachment means consists essentially of at least one stirrup and the female attachment means consists essentially of at least one pair of slots, each pair of slots dimensioned and situated so as to engage a stirrup.

9. A message board comprising a rectangular frame and at least one functional area including at least one member of the group consisting of a calendar, a dry-erase message surface, and a holder for a pad of adhesive notes, wherein the frame includes at least one frame member comprising storage means for storing at least one writing means in an orientation colinear with the frame member and with the frame member.

10. A device of claim 9 in which a plurality of frame members comprise storage means.

11. A device of claim 10 in which all four frame members comprise storage means.

* * * * *

UNITED STATES PATENT AND TRADEMARK OFFICE

CERTIFICATE OF CORRECTION

PATENT NO : 5,987,825

DATED : November 23, 1999

INVENTOR(S) : Lawrence I. Rosen

It is certified that error appears in the above-identified patent and that said Letters Patent is hereby corrected as shown below:

Column 4, line 54 (Claim 9, line 7): After "member and" delete "with" and insert --within--.

Signed and Sealed this

Ninth Day of May, 2000

*Attest:*

Q. TODD DICKINSON

*Attesting Officer*

*Director of Patents and Trademarks*